US006585394B2

(12) United States Patent
Diaco

(10) Patent No.: US 6,585,394 B2
(45) Date of Patent: Jul. 1, 2003

(54) OUTDOOR LIGHT STRING SUPPORT SYSTEM

(76) Inventor: Raffaele Diaco, 478 Mount Prospect Ave., Clifton, NJ (US) 07012

( * ) Notice: Subject to any disclaimer, the term of this patent is extended or adjusted under 35 U.S.C. 154(b) by 0 days.

(21) Appl. No.: 09/982,659

(22) Filed: Oct. 18, 2001

(65) Prior Publication Data

US 2003/0076678 A1 Apr. 24, 2003

(51) Int. Cl.[7] ..... F21V 21/00
(52) U.S. Cl. ..... 362/249; 362/396; 362/145
(58) Field of Search ..... 362/147, 145, 362/249, 250, 252, 396, 432, 806

(56) References Cited

U.S. PATENT DOCUMENTS

| | | | | |
|---|---|---|---|---|
| 3,599,918 A | * | 8/1971 | Patchett | 362/396 |
| 3,692,993 A | * | 9/1972 | Robinson | 362/806 |
| 5,161,882 A | | 11/1992 | Garrett | 362/249 |
| 5,165,790 A | * | 11/1992 | Boschetto | 362/396 |
| 5,544,028 A | | 8/1996 | Carlin | 362/249 |
| 5,707,136 A | | 1/1998 | Byers | 362/145 |
| 6,033,088 A | | 3/2000 | Contigiani | 362/249 |
| 6,050,703 A | | 4/2000 | Herbert | 362/250 |
| 6,179,440 B1 | | 1/2001 | Palmer | 362/249 |
| 6,186,644 B1 | | 2/2001 | Mosseau | 362/249 |
| 6,217,192 B1 | | 4/2001 | Stratton | 362/249 |

* cited by examiner

*Primary Examiner*—Y. My Quach-Lee
(74) *Attorney, Agent, or Firm*—Michael S. Neustel

(57) ABSTRACT

An outdoor light string support system for supporting and organizing string lights beneath an eave of a building. The outdoor light string support system, includes a support member having a first member, a second member extending downwardly from an edge of the first member, a third member traversely extending from the second member, and a plurality of apertures within the third member for receiving a plurality of bulbs or branch wires from a light string. The first member is formed to be frictionally received between the lower edge of the fascia and the soffit of a building eave. The plurality of bulbs are sufficiently exposed from within the apertures to be seen from the front of the building with the main wire of the light string hidden behind the second member. In an alternative embodiment, an S-shaped hook member is attached to each of the apertures for supporting the light string a finite distance below the third member.

16 Claims, 10 Drawing Sheets

OUTDOOR LIGHT STRING SUPPORT SYSTEM

BACKGROUND OF THE INVENTION

1. Field of the Invention

The present invention relates generally to string light support devices and more specifically it relates to an outdoor light string support system for supporting and organizing light strings beneath an eave of a building.

2. Description of the Prior Art

Examples of patented devices include U.S. Pat. No. 5,707,136 to Byers; U.S. Pat. No. 6,217,192 to Stratton; U.S. Pat. No. 5,161,882 to Garrett; U.S. Pat. No. 6,050,703 to Herbert; U.S. Pat. No. 6,186,644 to Mosseau; U.S. Pat. No. 6,033,088 to Contigiani; U.S. Pat. No. 5,544,028 to Carlin; U.S. Pat. No. 6,179,440 to Palmer.

While these devices may be suitable for the particular purpose to which they address, they are not as suitable for conveniently supporting and organizing light strings beneath an eave of a building. Conventional light string support devices are difficult to install and do not provide a consistent appearance for the light strings.

In these respects, the outdoor light string support system according to the present invention substantially departs from the conventional concepts and designs of the prior art, and in so doing provides an apparatus primarily developed for the purpose of supporting and organizing light strings beneath an eave of a building.

SUMMARY OF THE INVENTION

In view of the foregoing disadvantages inherent in the known types of light string support devices now present in the prior art, the present invention provides a new outdoor light string support system construction wherein the same can be utilized for supporting and organizing light strings beneath an eave of a building.

The general purpose of the present invention, which will be described subsequently in greater detail, is to provide a new outdoor light string support system that has many of the advantages of the lights string support devices mentioned heretofore and many novel features that result in a new outdoor light string support system which is not anticipated, rendered obvious, suggested, or even implied by any of the prior art light string support devices, either alone or in any combination thereof.

To attain this, the present invention generally comprises a support member having a first member, a second member extending downwardly from an edge of the first member, a third member traversely extending from the second member, and a plurality of apertures within the third member for receiving a plurality of bulbs or branch wires from a light string. The first member is formed to be frictionally received between the lower edge of the fascia and the soffit of a building eave. The plurality of bulbs are sufficiently exposed from within the apertures to be seen from the front of the building with the main wire of the light string hidden behind the second member. In an alternative embodiment, an S-shaped hook member is attached to each of the apertures for supporting the light string a finite distance below the third member.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an outdoor light string support system that will overcome the shortcomings of the prior art devices.

A second object is to provide an outdoor light string support system for supporting and organizing light strings beneath an pave of a building.

Another object is to provide an outdoor light string support system that provides a straight and consistent appearance to light strings.

A further object is to provide an outdoor light string support system that easily and conveniently attaches between the lower portion of the fascia and the soffit of an eave of a building.

An additional object is to provide an outdoor light string support system that are easy to install and effectively reduce installation time for light strings.

A further object is to provide an outdoor light string support system that may remain attached to the building without adversely affecting the building structure's integrity or appearance.

Another object is to provide an outdoor light string support system that provide a convenient means for storing the light strings when removed from the building.

A further object is to provide an outdoor light string support system that may be utilized upon various types of building structures.

A further object is to provide an outdoor light string support system that effectively hides the main line of the light string from viewing by third-parties thereby increasing the aesthetics of a building structure.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
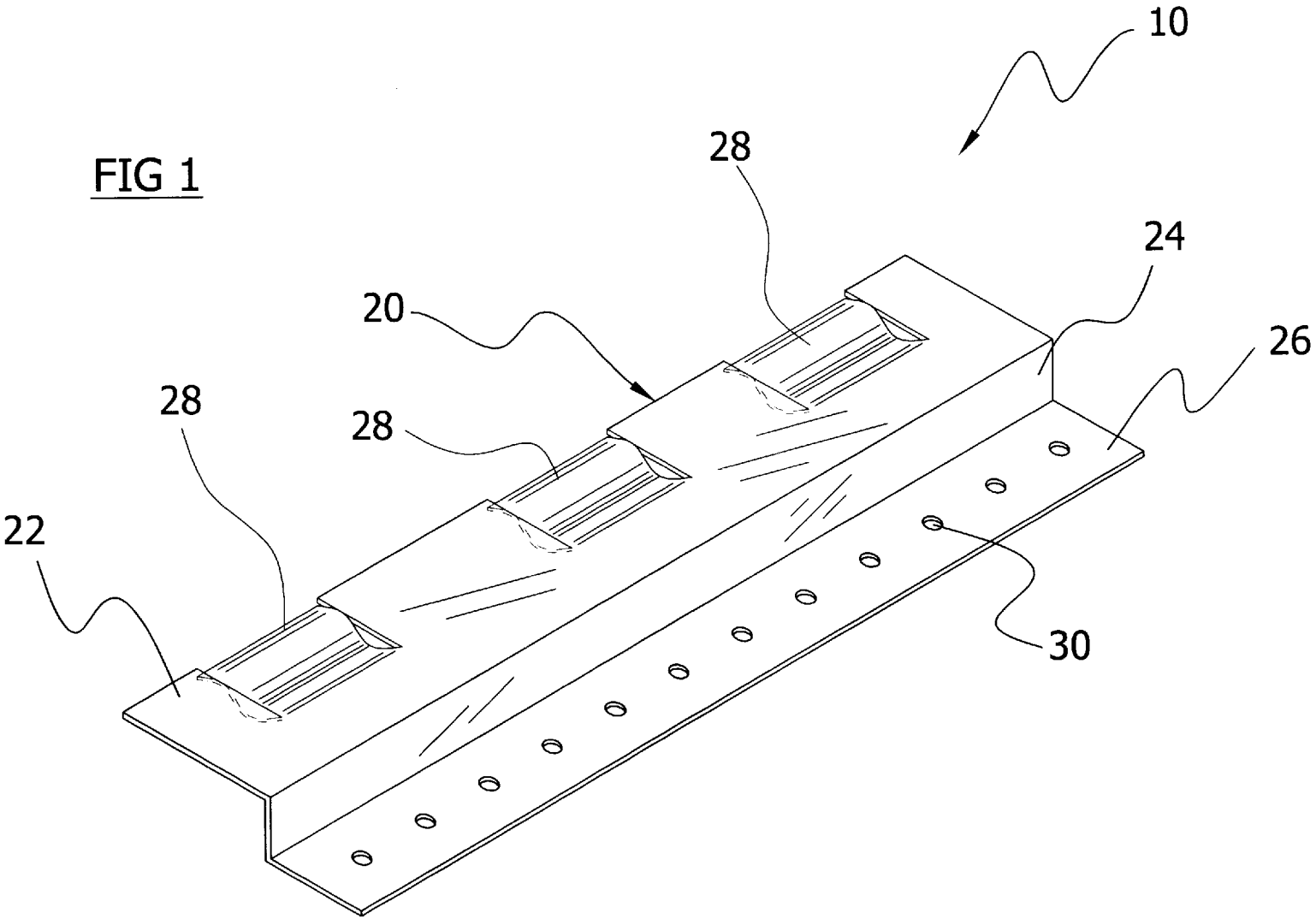
FIG. 1 is a rear upper perspective view of the present invention.

Turning now descriptively to the drawings, in which similar reference characters denote similar elements throughout the several views, FIGS. 1 through 10 illustrate an outdoor light string support system 10, which basically comprises a support member 20 having a first member 22, a second member 24 extending downwardly from an edge of the first member 22, a third member 26 traversely extending from the second member 24, and a plurality of apertures 30 within the third member 26 for receiving a plurality of bulbs 14 or branch wires 72 from a light string. The first member 22 is formed to be frictionally received between the lower edge 18 of the fascia 16 and the soffit 19 of a building eave. The plurality of bulbs 14 are sufficiently exposed from within the apertures 30 to be seen from the front of the building with the main wire 12 of the light string hidden behind the second member 24. In an alternative embodiment, an S-shaped hook member 40 is attached to each of the apertures 30 for supporting the light string a finite distance below the third member 26.

As shown in FIGS. 1, 2, 4, 6, 7, 8 and 9 of the drawings, the support member 20 is comprised of an elongate structure having various lengths. The support member 20 may be comprised of various materials such as but not limited to plastic, metal or composite materials. The support member 20 may also be colored or painted to corresponding to the building structure being attached to.

Figure 5:
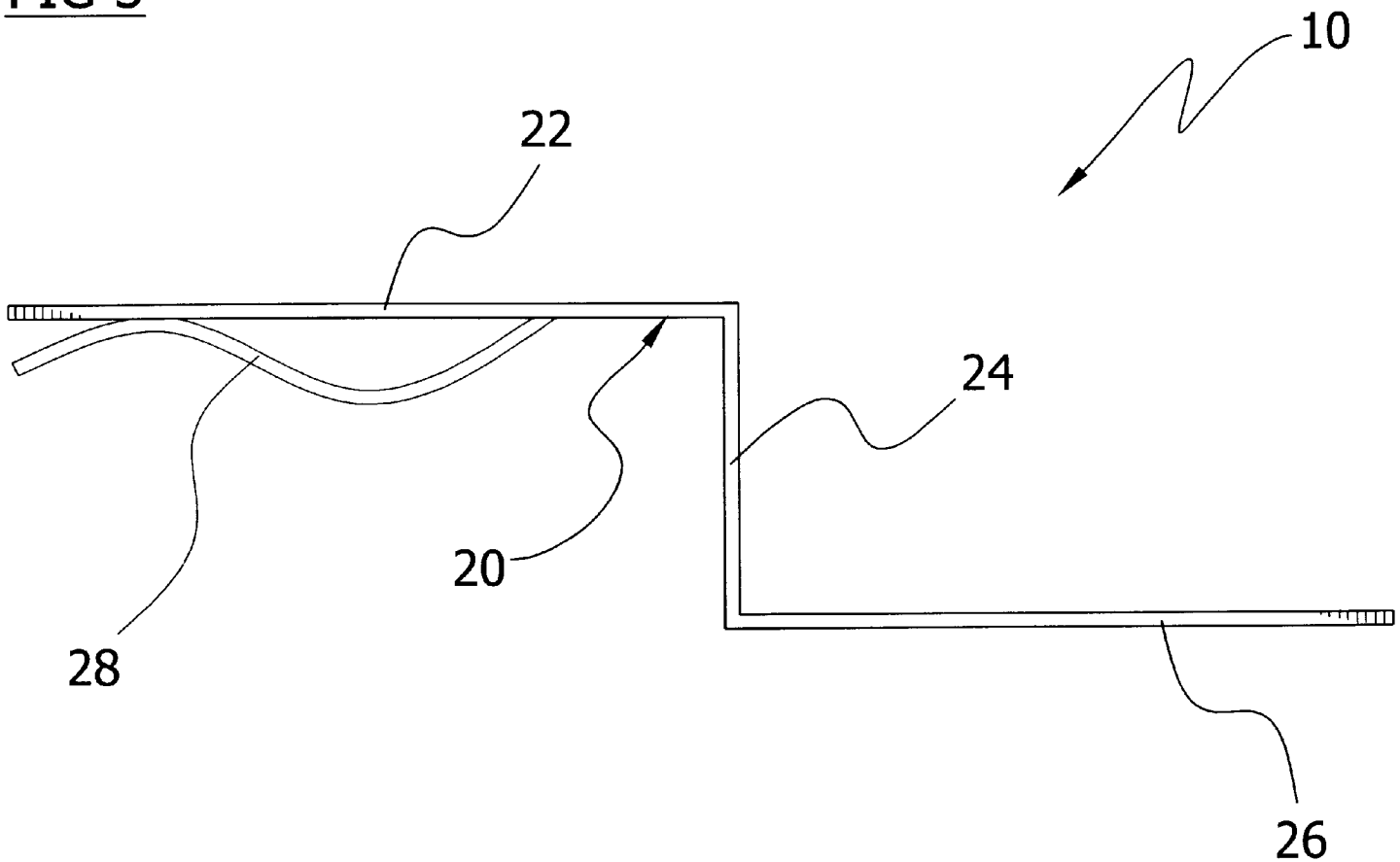
FIG. 5 is a side view of the present invention.
Figure 6:
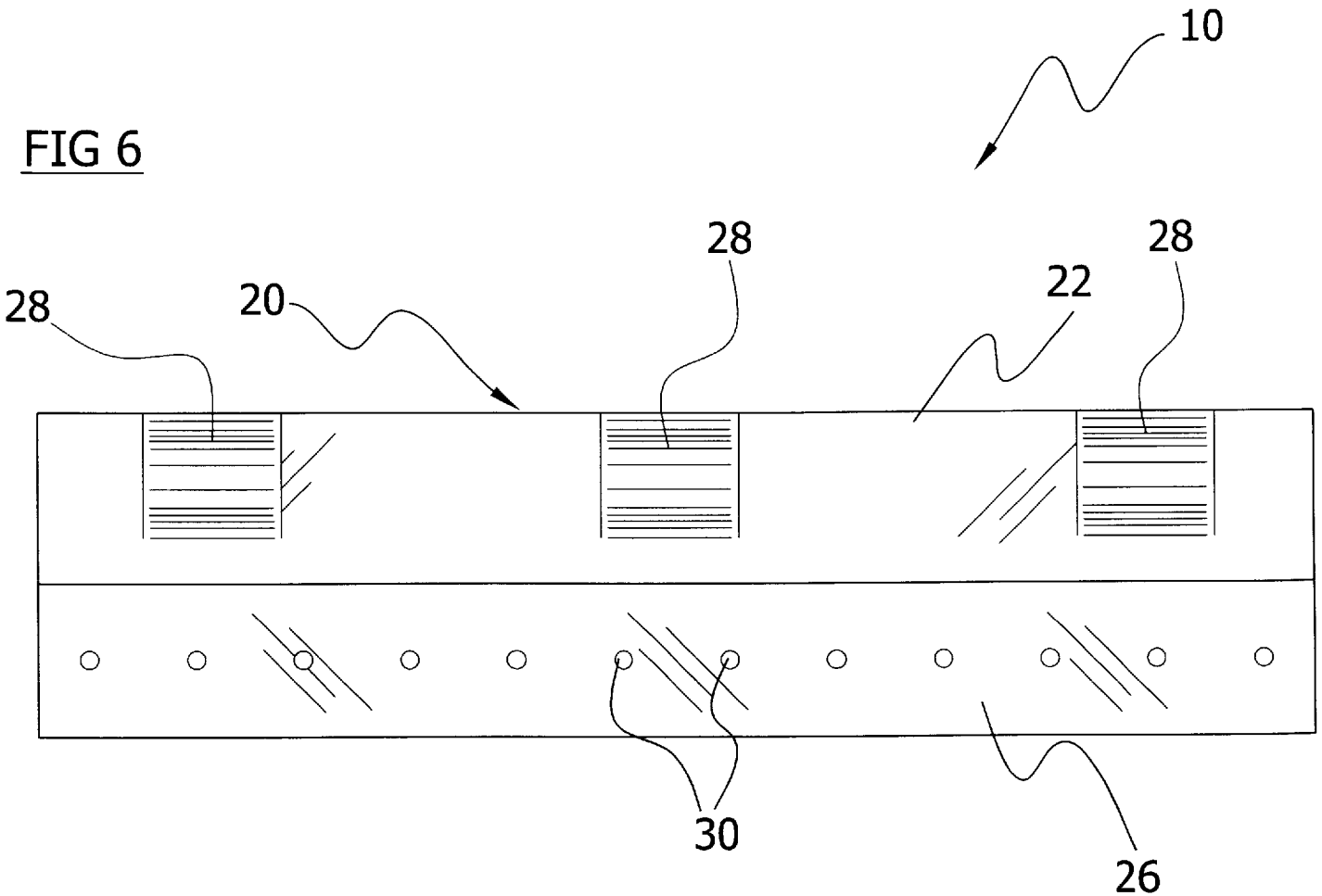
FIG. 6 is a top view of the present invention.
Figure 7:
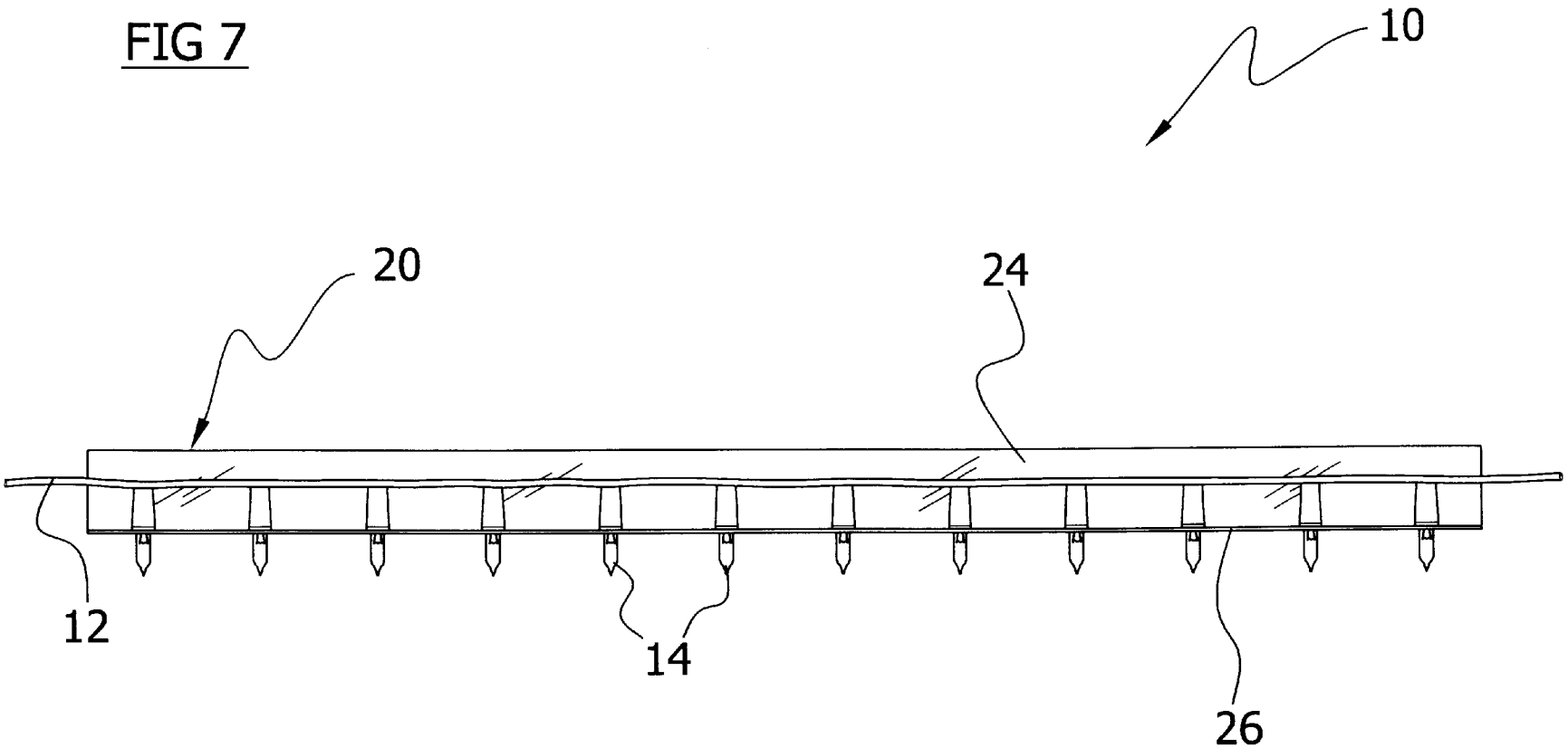
FIG. 7 is a front view of the present invention with the light string positioned within.
Figure 8:
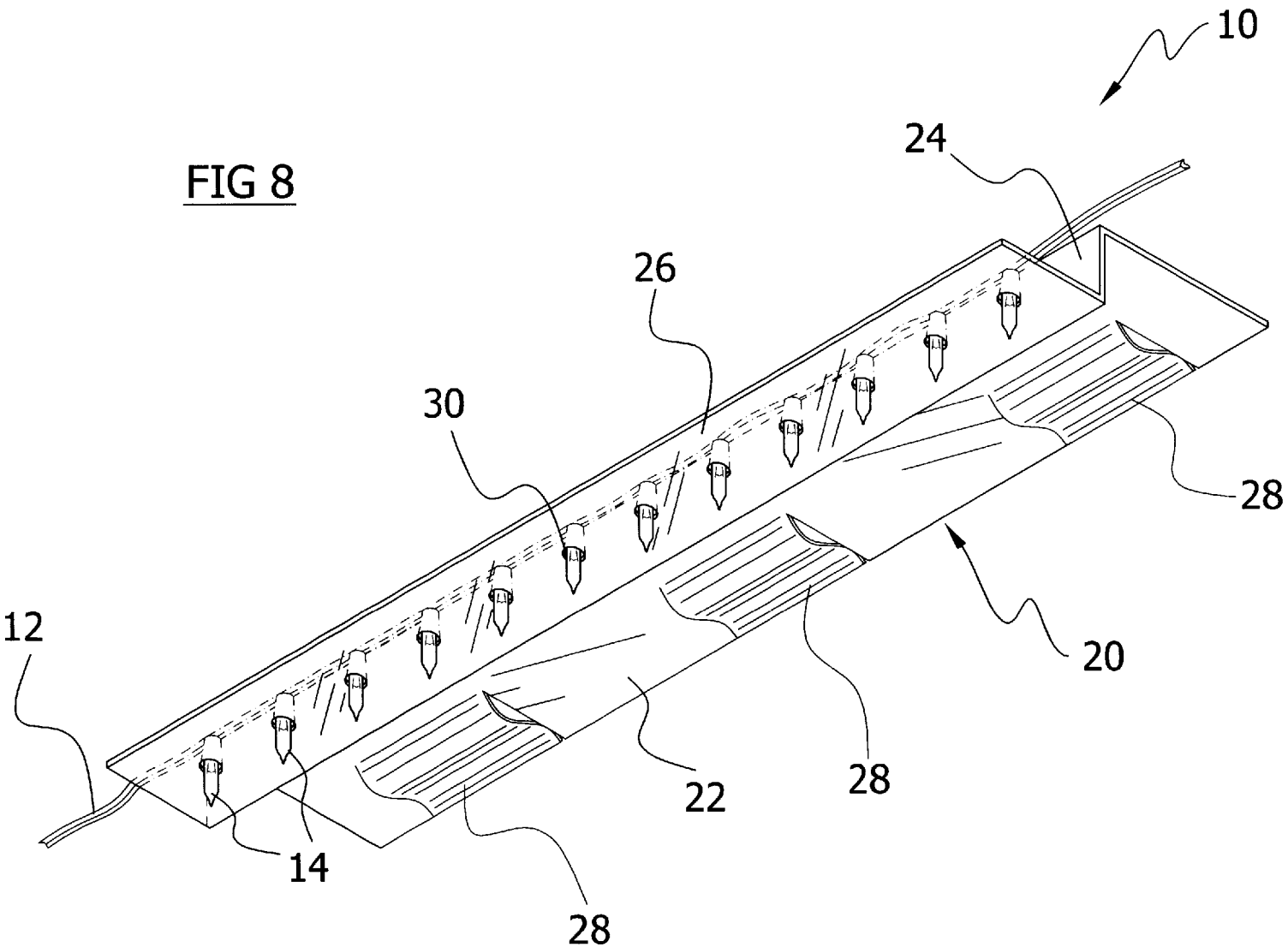
FIG. 8 is a rear lower perspective view of the present invention with the light string positioned within.

As best shown in FIGS. 1 and 5 of the drawings, the support member 20 is comprised of a first member 22, a second member 24 extending downwardly from an edge of the first member 22, and a third member 26 traversely extending from the second member 24. As best shown in FIG. 5 of the drawings, the first member 22 and third member 26 are substantially parallel to one another though it can be appreciated that various angles may exist between these members 22, 26 to create various affects. In addition, the second member 24 is preferably traverse to the first member 22 and the third member 26, however various other angles may be utilized.

As shown in FIGS. 1 and 5 of the drawings, the first member 22 has a defined width and thickness sufficient to be positioned between the lower edge 18 of the fascia 16 and the soffit 19. The first member 22 is preferably comprised of a consistent width, however irregularities may exist within the first member 22 such as slots, notches or the like to reduce the overall weight of the structure. The first member 22 preferably has a plurality of clip members 28 for securing it to the lower edge 18 of the fascia 16 though the clip members 28 are not required for installation of the present invention. The first member 22 preferably has a thickness sufficient to be inserted between the lower edge 18 of the fascia 16 and the soffit 19 without being accidentally removed by wind or other natural forces. The first member 22 also is formed to provide sufficient support to the remaining portion of the support member 20 and the length of light string attached thereto.

Figure 2:
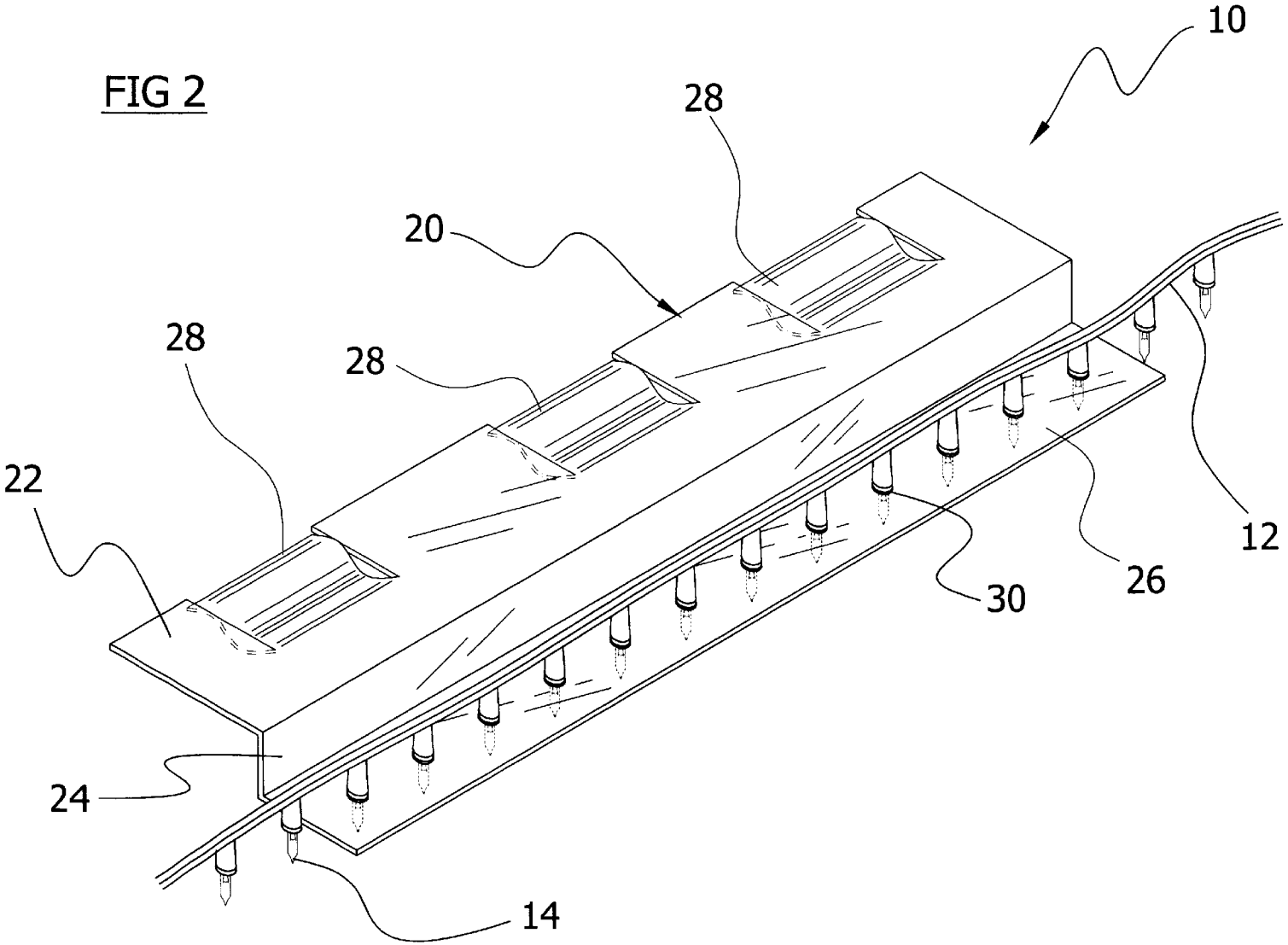
FIG. 2 is a rear upper perspective view of the present invention with a light string positioned within.
Figure 3:
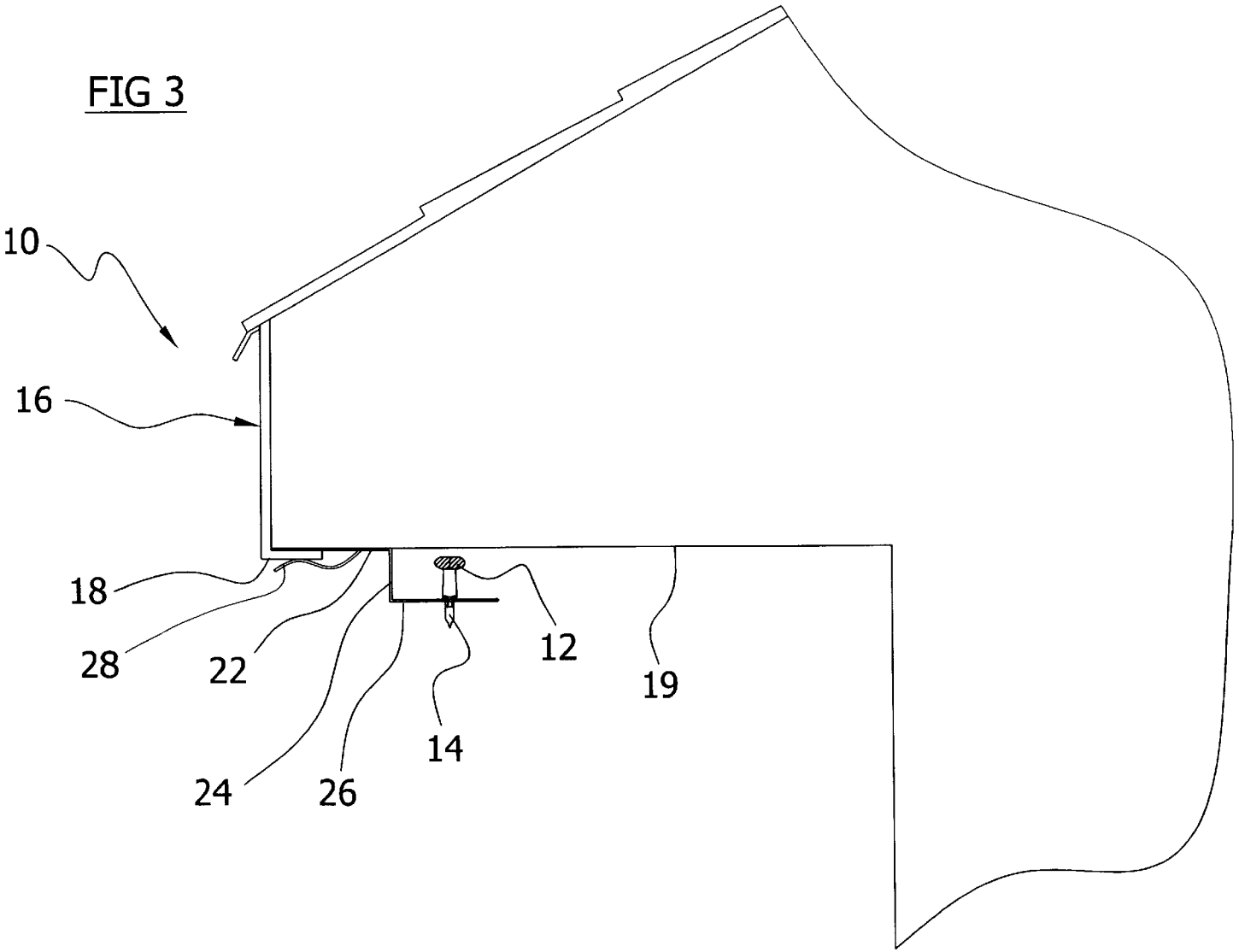
FIG. 3 is a side view of the present invention attached beneath an eave of a building and more particularly between the lower portion of the fascia and the soffit.
Figure 4:
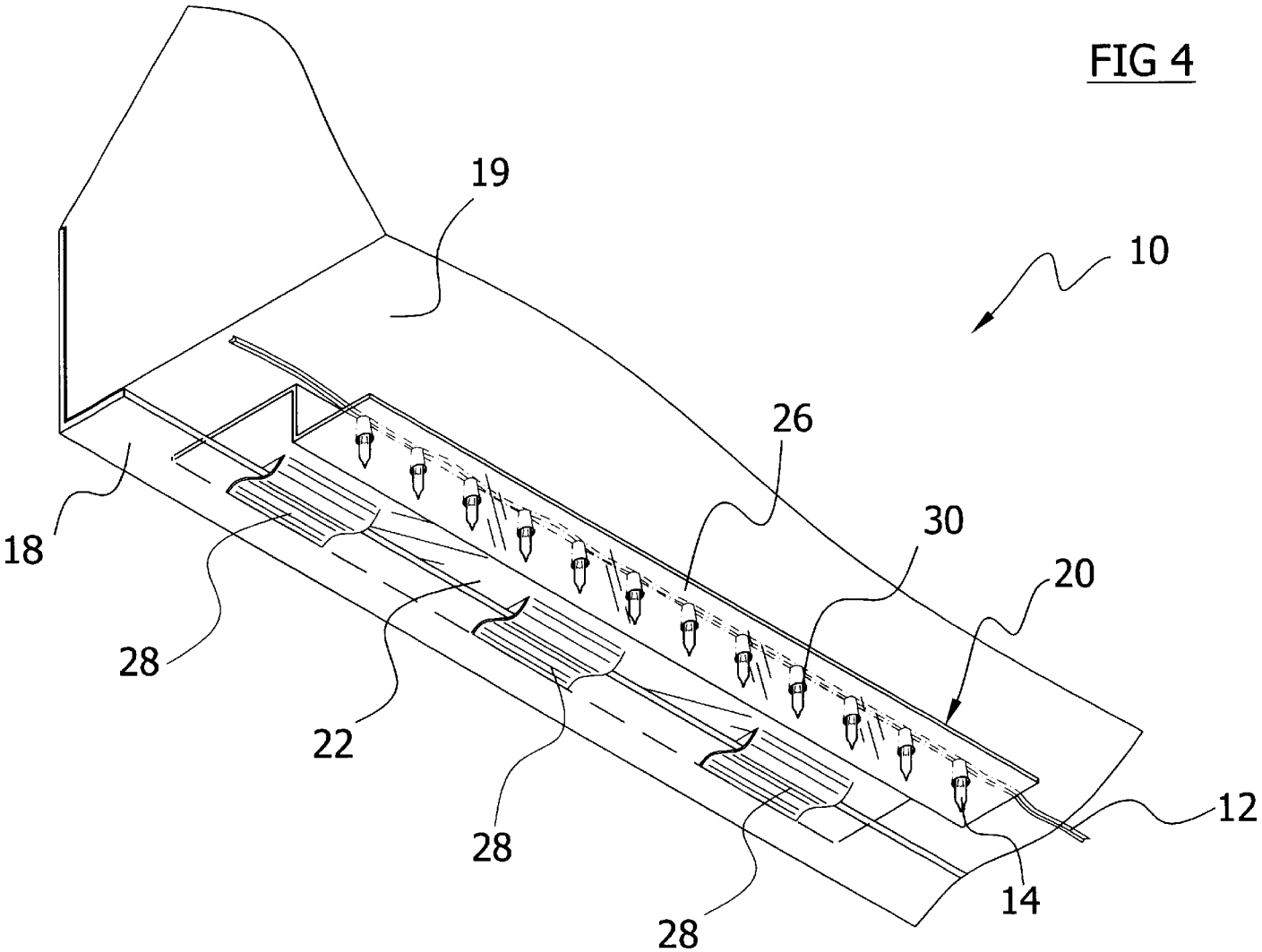
FIG. 4 is a rear lower perspective view of the present invention attached between the lower portion of the fascia and the soffit.

As shown in FIGS. 1, 2, 3, 4, 5 and 7 of the drawings, the second member 24 extends downwardly from the first member 22 a sufficient distance for receiving the light string. The second member 24 is also preferably comprised of an opaque material for hiding the appearance of the main wire 12 of the light string as best illustrated in FIGS. 2 and 3 of the drawings.

As shown in FIGS. 1 through 6 of the drawings, the third member 26 extends rearwardly from the second member 24 opposite of the first member 22. The third member 26 has a plurality of apertures 30 within for receiving a corresponding plurality of bulbs 14 or branch wires 72. The apertures 30 are formed for receiving various sizes and shapes of bulbs 14 as can be appreciated and may have various shapes and sizes themselves. The apertures 30 are preferably distally spaced equidistance, however various distances may be utilized to create various effects with the light string.

Figure 9:
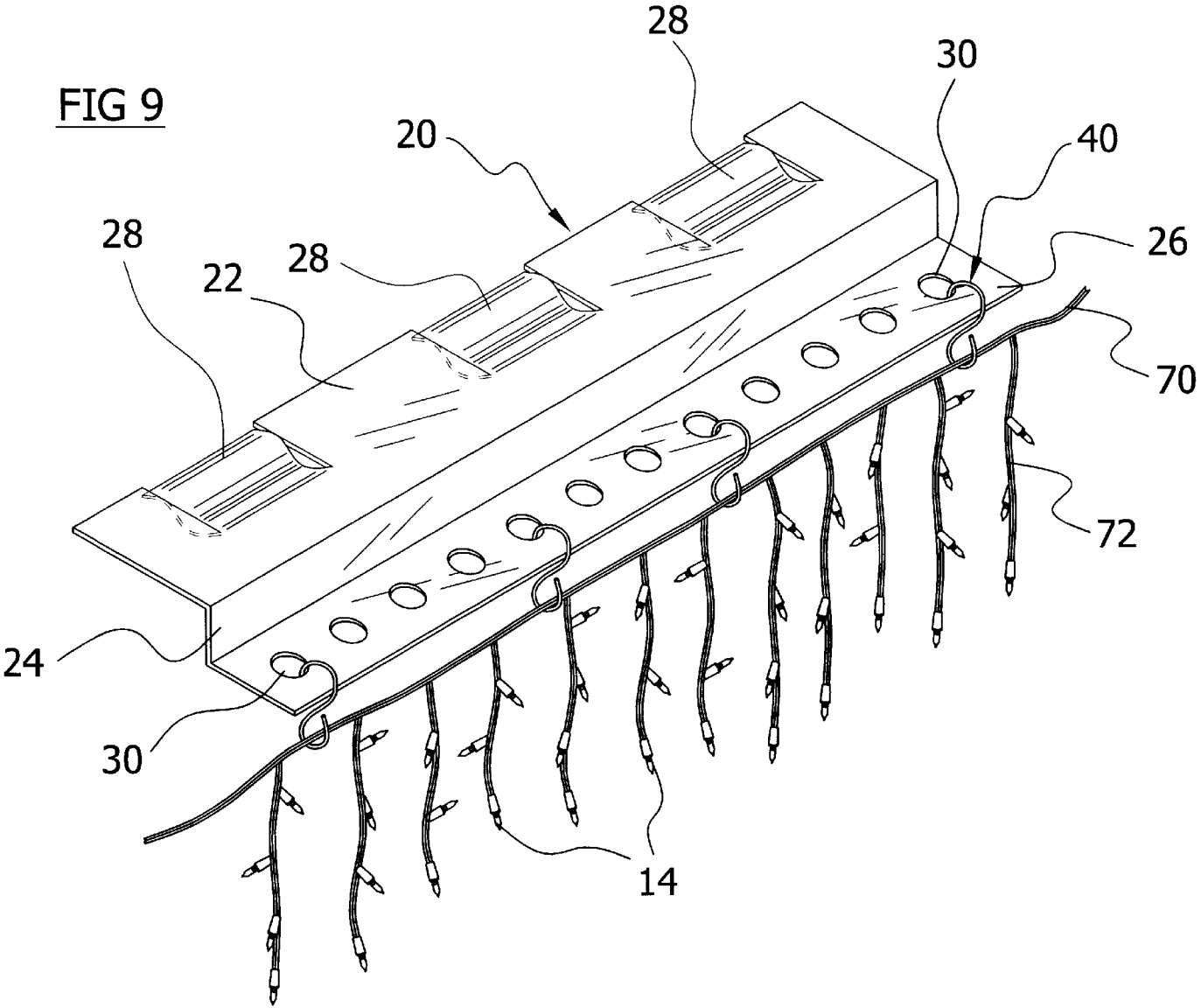
FIG. 9 is an upper perspective view of an alternative embodiment of the present invention utilizing the usage of hook members.
Figure 10:
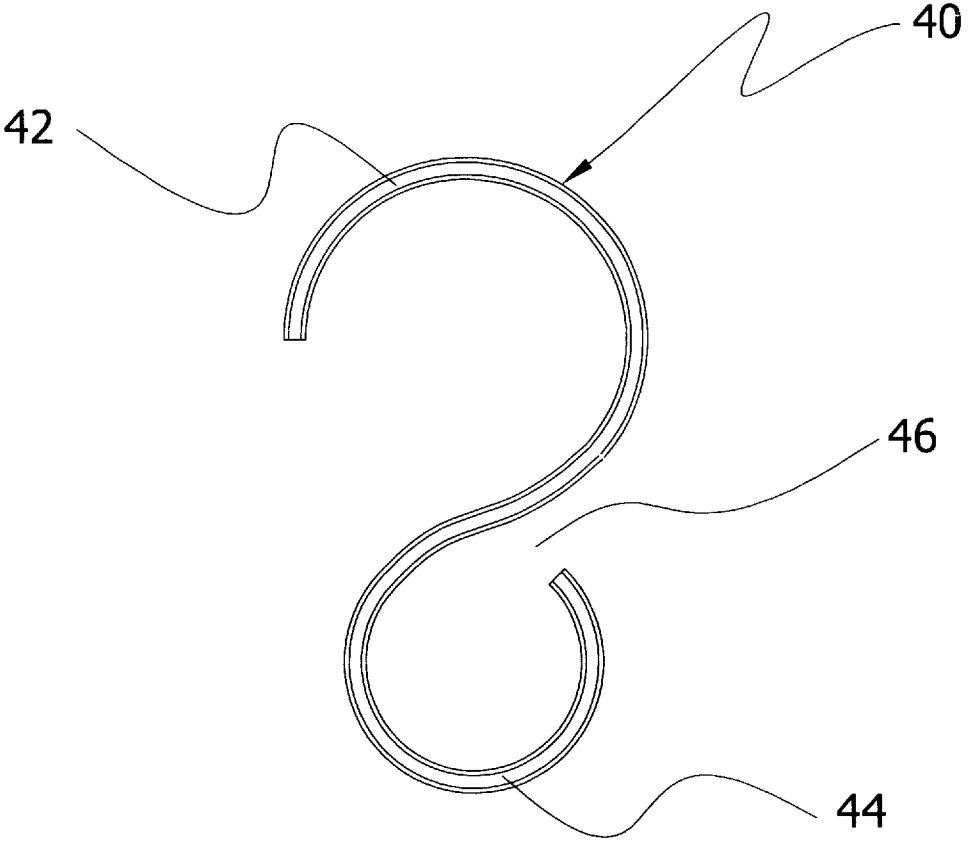
FIG. 10 is a side view of a hook member.

In an alternative embodiment as illustrated in FIGS. 9 and 10 of the drawings, a hook member 40 having an S-shape is utilized for supporting the light string below the third member 26. The hook member 40 includes an upper hook portion 42 that is securable within the plurality of apertures 30. The lower hook portion 44 includes a lower opening 46 for receiving the main cable 70 of the light string. The alternative embodiment utilizing the hook member 40 is preferably utilized for securing non-conventional light strings such as "icicle" light strings and the like (see www.christmasdepot.com for additional variations of light strings which are well known in the art). However, the alternative embodiment utilizing the hook member 40 may be utilized to support conventional light strings.

There are two main methods of utilizing the present invention. The first method involves positioning the light string within the support member 20 prior to installing the support member 20 within the fascia 16. The user positions each of the bulbs 14 within the apertures 30 within the third member 26 as best illustrated within FIGS. 2 and 8 of the drawings. The user combines the required number of support members 20 as needed to fully support the entire length of the light string by positioning the support members 20 end to end. The user may have to cut one or more support members 20 to accommodate varying widths of the fascia 16 as can be appreciated. It can further be appreciated that the support member 20 may be bent or manipulated into various structures to further conform to irregularities in the fascia 16 such as curvatures and the like. After the light string and the corresponding bulbs 14 are positioned within the support members 20, the user then inserts the first support member 20 between the lower edge 18 of the fascia 16 and the soffit 19 until snugly received and retained between thereof. The user continues this process until all of the support members 20 are snugly secured between the lower edge 18 of the fascia 16 and the soffit 19 to support the entire length of the light string. The user then connects a power source to the light string thereby illuminating the bulbs 14 with the main wire 12 hidden from view. It can be appreciated that the same process applies to the alternative embodiment except with the installation of the hook members 40 within the apertures 30 followed by the installation of the light string by positioning the main cable 70 within the lower hook portion 44 through the lower opening 46 thereby supporting the branch wires 72 in a vertical manner.

The second method involves positioning the light string within the support member 20 after installing the support member 20 within the fascia 16. The user inserts the first support member 20 between the lower edge 18 of the fascia 16 and the soffit 19 until snugly received and retained between thereof. The user continues this process until all of the support members 20 are snugly secured between the lower edge 18 of the fascia 16 and the soffit 19 to support the entire length of the light string. The user combines the required number of support members 20 as needed to fully support the entire length of the light string by positioning the support members 20 end to end. The user may have to cut one or more support members 20 to accommodate varying widths of the fascia 16 as can be appreciated. It can further be appreciated that the support member 20 may be bent or manipulated into various structures to further conform to irregularities in the fascia 16 such as curvatures and the like. The user then positions each of the bulbs 14 within the apertures 30 within the third member 26 as best illustrated within FIGS. 2 and 8 of the drawings. The user then connects a power source to the light string thereby illuminating the bulbs 14 with the main wire 12 hidden from view. It can be appreciated that the same process applies to the alternative embodiment except with the installation of the hook members 40 within the apertures 30 followed by the installation of the light string by positioning the main cable 70 within the lower hook portion 44 through the lower opening 46 thereby supporting the branch wires 72 in a vertical manner.

Regardless of the method of installation utilized, the present invention provides a convenient storage system when removed from the building structure. The user simply removes the support members 20 from the building structure with the light string remaining attached thereto. The user then "folds" the respective support members 20 with the light strings attached thereto and then positions the folded structure into a convenient location such as a tubular storage container with a lid.

As to a further discussion of the manner of usage and operation of the present invention, the same should be apparent from the above description. Accordingly, no further discussion relating to the manner of usage and operation will be provided.

With respect to the above description then it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An outdoor light string support system, comprising:

a support member having a first member, a second member extending from said first member, and a third member extending from said second member, wherein said first member is formed for being received between a lower edge of a fascia and a soffit;

a plurality of apertures within said third member for receiving a plurality of bulbs from a light string; and a plurality of hook members catchably secured within said plurality of apertures and formed for receiving a main wire of said light string.

2. The outdoor light string support system of claim 1, wherein said first member is substantially parallel to said third member, and wherein said third member extends away from said first member.

3. The outdoor light string support system of claim 2, wherein said second member is traversely positioned between said first member and said third member.

4. The outdoor light string support system of claim 1, wherein said plurality of apertures are equidistantly spaced apart.

5. The outdoor light string support system of claim 1, wherein said second member is formed for hiding a main wire of said light string.

6. The outdoor light string support system of claim 1, wherein said first member and said third member are substantially equal in length and width.

7. The outdoor light string support system of claim 6, wherein said second member has a height smaller than said width of said first member and said third member.

8. The outdoor light string support system of claim 1, wherein said apertures are circular shaped.

9. The outdoor light string support system of claim 1, wherein each of said plurality of hook members includes an upper hook portion attachable within said apertures, a lower hook portion for supporting said main wire, and a lower opening for receiving said main wire.

10. The outdoor light string support system of claim 1, wherein said first member includes a plurality of clip members.

11. A method of installing an outdoor light string utilizing a plurality of support members each having a first member, a second member extending from said first member, a third member extending from said second member, wherein said first member is formed for being received between a lower edge of a fascia and a soffit, and a plurality of apertures within said third member for receiving a plurality of bulbs from a light string, said method comprising the steps of:

(a) positioning said first member of a first support member between said lower edge of said fascia and said soffit;

(b) positioning additional support members between said lower edge of said fascia and said soffit if required; and (c) positioning a plurality of bulbs within said plurality of apertures within said third member.

12. The method of installing an outdoor light string of claim 11, including the steps of:

(d) removing said plurality of support members from between said lower edge of said fascia and said soffit; and (e) folding said plurality of said support members into a compact storage structure.

13. The method of installing an outdoor light string of claim 12, including the step of (f) positioning said compact storage structure into a storage container.

14. A method of installing an outdoor light string utilizing a plurality of support members each having a first member, a second member extending from said first member, a third member extending from said second member, wherein said first member is formed for being received between a lower edge of a fascia and a soffit, and a plurality of apertures within said third member for receiving a plurality of bulbs from a light string, said method comprising the steps of:

(a) positioning a plurality of bulbs within said plurality of apertures within said third member of said plurality of support members; and (b) positioning said first member of said support member between said lower edge of said fascia and said soffit.

15. The method of installing an outdoor light string of claim 14, including the steps of:

(c) removing said plurality of support members from between said lower edge of said fascia and said soffit; and (d) folding said plurality of support members with said light string positioned within into a compact storage structure.

16. The method of installing an outdoor light string of claim 15, including the step of (e) positioning said compact storage structure into a storage container.

* * * * *